US009955768B1

(12) United States Patent
McGraw

(10) Patent No.: US 9,955,768 B1
(45) Date of Patent: May 1, 2018

(54) LIP BALM DISPENSER

(71) Applicant: PPP&C, INC., Los Angeles, CA (US)

(72) Inventor: Robin McGraw, Los Angeles, CA (US)

(73) Assignee: PPP&C, INC., Burbank, CA (US)

( * ) Notice: Subject to any disclaimer, the term of this patent is extended or adjusted under 35 U.S.C. 154(b) by 86 days.

(21) Appl. No.: 15/332,307

(22) Filed: Oct. 24, 2016

(51) Int. Cl.
*A45D 40/20* (2006.01)
*A45D 40/00* (2006.01)
*A45D 40/16* (2006.01)

(52) U.S. Cl.
CPC ..... *A45D 40/20* (2013.01); *A45D 40/16* (2013.01); *A45D 2040/0012* (2013.01); *A45D 2040/0025* (2013.01); *A45D 2040/0062* (2013.01); *A45D 2040/201* (2013.01)

(58) Field of Classification Search
CPC ..... A45D 40/20; A45D 40/16; A45D 2040/0012; A45D 2040/0025; A45D 2040/0062; A45D 2040/201; A45D 2040/00; A45D 2040/0018; A45D 40/00; A45D 40/0081; A45D 40/0087
See application file for complete search history.

(56) References Cited

U.S. PATENT DOCUMENTS 6,193,427 B1 * 2/2001 Benguigui ..... A45D 40/16 206/823
6,497,523 B1 * 12/2002 Kuroiwa ..... A45D 40/06 106/38.2
8,444,337 B2 * 5/2013 Teller ..... A45D 40/00 206/385
8,651,308 B1 * 2/2014 Sung ..... A45D 40/00 206/457
9,232,544 B2 * 1/2016 Sundell ..... H04W 76/02

* cited by examiner

*Primary Examiner* — David Walczak
(74) *Attorney, Agent, or Firm* — Kevin Schraven; Anooj Patel; Hankin Patent Law, APC

(57) ABSTRACT

A lip balm dispenser, comprising: a base portion; a cap portion; and a plug. The base portion may be removeably connected to the cap portion. The base portion may comprise an aperture, a base exterior, and a support structure. The plug may be configured to block the aperture. The support structure may comprise a support surface. The cap portion may comprise a mold portion and a cap exterior. The mold portion may be substantially conical in shape. When the base portion is coupled to the cap portion, the base exterior and the cap exterior may form a substantially heart-shaped lip balm dispenser. When the base portion is coupled to the cap portion, the substantially heart-shaped lip balm dispenser may also form an internal cavity defined by the mold portion and the support surface. The internal cavity may be configured to accept a heated lip balm through the aperture.

20 Claims, 5 Drawing Sheets

LIP BALM DISPENSER

FIELD OF USE

The present disclosure relates generally to dispensers comprising lip balm, and more specifically, to dispensers for accepting lip balm via a hot pour method of manufacture.

BACKGROUND

The lips do not contain moisturizing and lipid-restoring glands like other parts of the skin. For this reason, the lips are continuously susceptible to becoming chapped. Furthermore, the lips can become chapped due to overexposure from various environmental elements. For example, lack of humidity in the air during the winter months is known to cause chapped lips and may even cause cracking that leads to bleeding lips. Similarly, frequent sun exposure during the summer can also lead to poor lip conditions. To counter these effects, lip balm may be used to treat chapped lips and keep the lips smooth, pain-free, and moist.

Proper formulation of lip balm is an important aspect in the manufacturing process, especially in order to prevent chapped lips from becoming a recurring, persistent problem. However, many lip balms on the market today contain irritating ingredients or lack beneficial oils, emollients, and repairing ingredients. Moreover, the containers of the lip balm may be uninspired or even ugly, leading to the user failing to use the lip balm when or as needed.

Lip balms are typically sold as emulsions, liquids, gels, or solids. Solid lip balms may be dispensable from tubes or from lipstick-type applicators and may be manufactured from a variety of methods. One such method is the hot pour method. During the hot pour method, the lip balm ingredients may be combined and heated until they are liquefied. The liquefied balm may then be directly poured into a lip balm application container, where it cools and solidifies.

The hot pour method may provide cost benefits over other methods, such as the bullet method. In the bullet method, the lip balm ingredients are also combined and heated until they are liquefied. However, unlike the hot pour method, the bullet method involves pouring the liquefied balm into molds where it is cooled and solidified. The solidified balm may then be cut into various shapes and inserted into a lip balm application container or lip balm dispenser.

Accordingly, the hot pour method removes the need for an intermediate step in which the liquefied balm is poured into molds and then transferred to a separate dispenser, thereby making the manufacturing process more efficient and eliminating the need for additional equipment.

Thus, what is needed is an attractive dispenser that comprises a mold and unique spokes or fins for accepting and holding a unique lip balm shape for applying lip balm to lips.

SUMMARY OF THE EMBODIMENTS

To minimize the limitations in the cited references, and to minimize other limitations that will become apparent upon reading and understanding the present specification, the present specification discloses a new and improved lip balm dispenser. The new lip balm dispenser may be attractive and may accept lip balm via a hot pour method.

One embodiment may be a lip balm dispenser, comprising: a base portion; a cap portion; and a plug; wherein the base portion is removeably connected to the cap portion; wherein the base portion comprises an aperture, a base exterior, and a support structure; wherein the plug is configured to block the aperture; wherein the support structure comprises a support surface; wherein the cap portion comprises a mold portion and a cap exterior; wherein the mold portion is substantially conical in shape; wherein when the base portion is connected to the cap portion, the base exterior and the cap exterior form a substantially heart-shaped lip balm dispenser; wherein when the base portion is connected to the cap portion, the substantially heart-shaped lip balm dispenser forms an internal cavity defined by the mold portion and the support surface; wherein the internal cavity is configured to accept a heated lip balm through the aperture; wherein the lip balm cools and adheres to the support surface; and wherein the lip balm does not adhere to the mold portion after the lip balm cools. The support structure may comprise one or more fins; wherein the one or more fins of the support structure may extend substantially perpendicularly from the support surface of the support structure. The one or more fins of the support structure may have one or more holes, which help the lip balm to adhere to the support surface. The base portion and the cap portion may be threadably connected. A coating, such as a non-stick coating, may be applied to the mold portion, such that the lip balm does not adhere to the mold portion after the lip balm cools. The support surface may have an outer rim that substantially surrounds the one or more fins and extends substantially perpendicularly from a base of the support surface. The outer rim may be cylindrical and preferably does not contact any of the one or more fins.

Another embodiment may be a lip balm dispenser, comprising: a base portion; a cap portion; a plug; and a lip balm; wherein the base portion is removeably connected to the cap portion; wherein the base portion comprises an aperture, a base exterior, and a support structure; wherein the plug is configured to block the aperture; wherein the support structure comprises a support surface and one or more fins; wherein the one or more fins have one or more holes; wherein the cap portion comprises a mold portion and a cap exterior; wherein the mold portion is substantially conical in shape; wherein when the base portion is connected to the cap portion, the lip balm dispenser forms an internal cavity defined by the mold portion and the support surface; wherein the lip balm is heated until it may be poured into the internal cavity; wherein the internal cavity is configured to accept a heated lip balm through the aperture; wherein the lip balm cools and adheres to the support surface and the fins; and wherein a coating is applied to the mold portion, such that the lip balm does not adhere to the mold portion after the lip balm cools. The one or more fins may extend substantially perpendicularly from the support surface of the support structure. The base portion and the cap portion may be threadably connected, so that they can screw together and unscrew apart. When the base portion is connected to the cap portion, the base exterior and the cap exterior may form a substantially heart-shaped lip balm dispenser.

Another embodiment may be a lip balm dispenser, comprising: a base portion; a cap portion; a plug; and a lip balm wherein the base portion is removeably connected to the cap portion; wherein the base portion comprises an aperture, a base exterior, and a support structure; wherein the plug is configured to block the aperture; wherein the support structure comprises a support surface and one or more fins; wherein the one or more fins have one or more holes; wherein the cap portion comprises a mold portion and a cap exterior; wherein when the base portion is connected to the cap portion, the base exterior and the cap exterior form a substantially heart-shaped lip balm dispenser; wherein when the base portion is connected to the cap portion, the substantially heart-shaped lip balm dispenser forms an internal cavity defined by the mold portion and the support surface; wherein the lip balm is heated until it may be poured into the internal cavity; wherein the internal cavity is configured to accept a heated lip balm through the aperture; wherein the lip balm cools and adheres to the support surface and the fins; and wherein a coating is applied to the mold portion, such that the lip balm does not adhere to the mold portion after the lip balm cools. The coating may be a non-stick coating that is food grade and generally regarded as safe for human use and consumption. The one or more fins may extend substantially perpendicularly from a base of the support surface of the support structure. The support surface may have an outer rim that substantially surrounds the one or more fins and may extend substantially perpendicularly from the base of the support surface. The outer rim may be cylindrical. The outer rim preferably does not contact any of the one or more fins. The base portion and the cap portion may be threadably connected. The mold portion may be substantially conical in shape.

It is an object to provide a lip balm dispenser that comprises a conical mold that accepts hot pour liquefied lip balm. The dispenser may have a heart-shaped exterior and may be unscrewed to reveal the conical lip balm, which, once solidified, is held firmly in place by perforated fins.

It is an object to overcome the limitations of the prior art.

Other features and advantages inherent in the dispenser, as claimed and disclosed will become apparent to those skilled in the art from the following detailed description and its accompanying drawings.

BRIEF DESCRIPTION OF THE DRAWINGS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF THE DRAWINGS

In the following detailed description, numerous specific details are set forth in order to provide a thorough understanding of various aspects of the embodiment of the lip balm dispenser. However, these embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The Figures, and their detailed descriptions, are to be regarded as illustrative in nature and not restrictive. Also, the reference or non-reference to a particular embodiment shall not be interpreted to limit the scope of protection.

In the following description, certain terminology is used to describe certain features of these embodiments. For purposes of this specification, unless otherwise specified, the term "substantially" refers to the complete or nearly complete extent or degree of an action, characteristic, property, state, structure, item, or result. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 5% of the indicated number or range of numbers. In one embodiment, the term "approximately" and "about", may refer to a deviance of between 1-10% from the indicated number or range of numbers.

Figure 1:
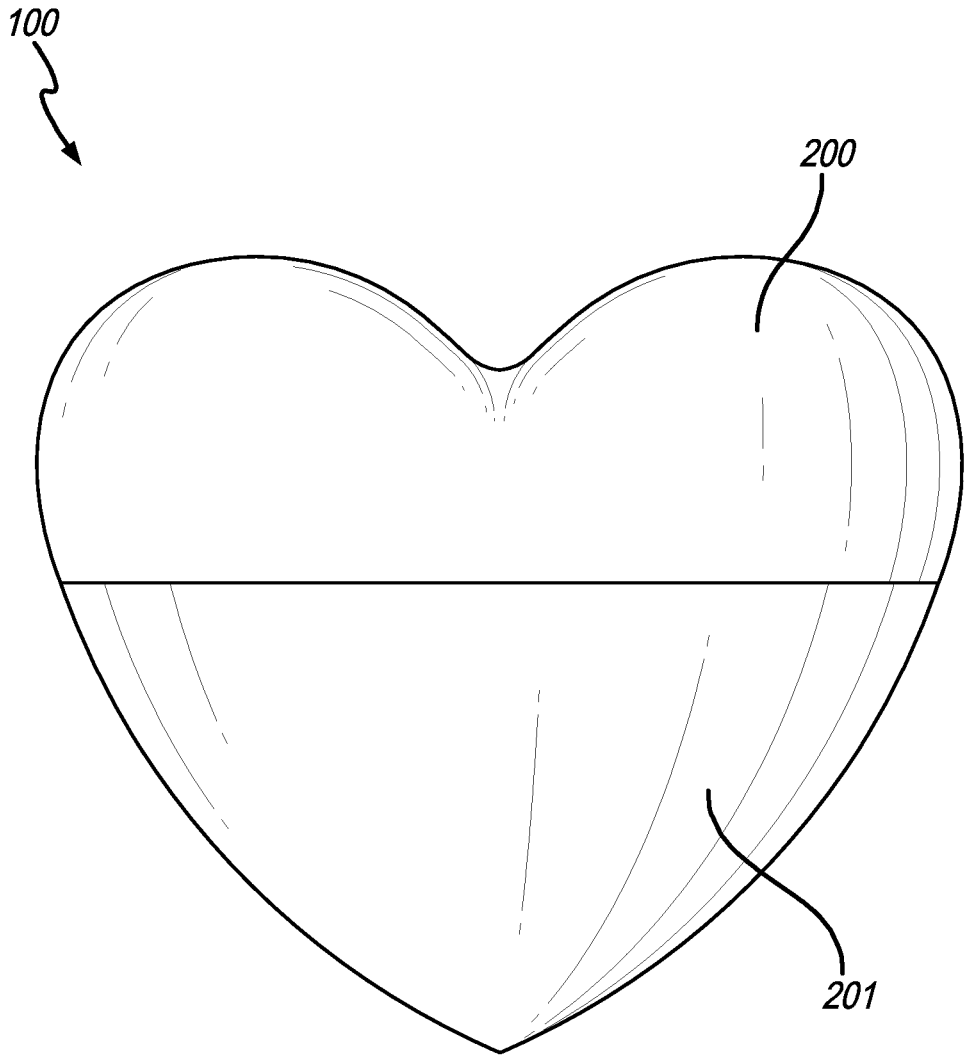
FIG. 1 is an illustration of a front view of one embodiment of the lip balm dispenser.

FIG. 1 is an illustration of a front view of one embodiment of the lip balm dispenser. As shown in FIG. 1, the lip balm dispenser 100 may have a substantially heart-shaped exterior. The lip balm dispenser may comprise: a base portion 200 and a cap portion 201. These two portions are preferably separable.

Figure 2:
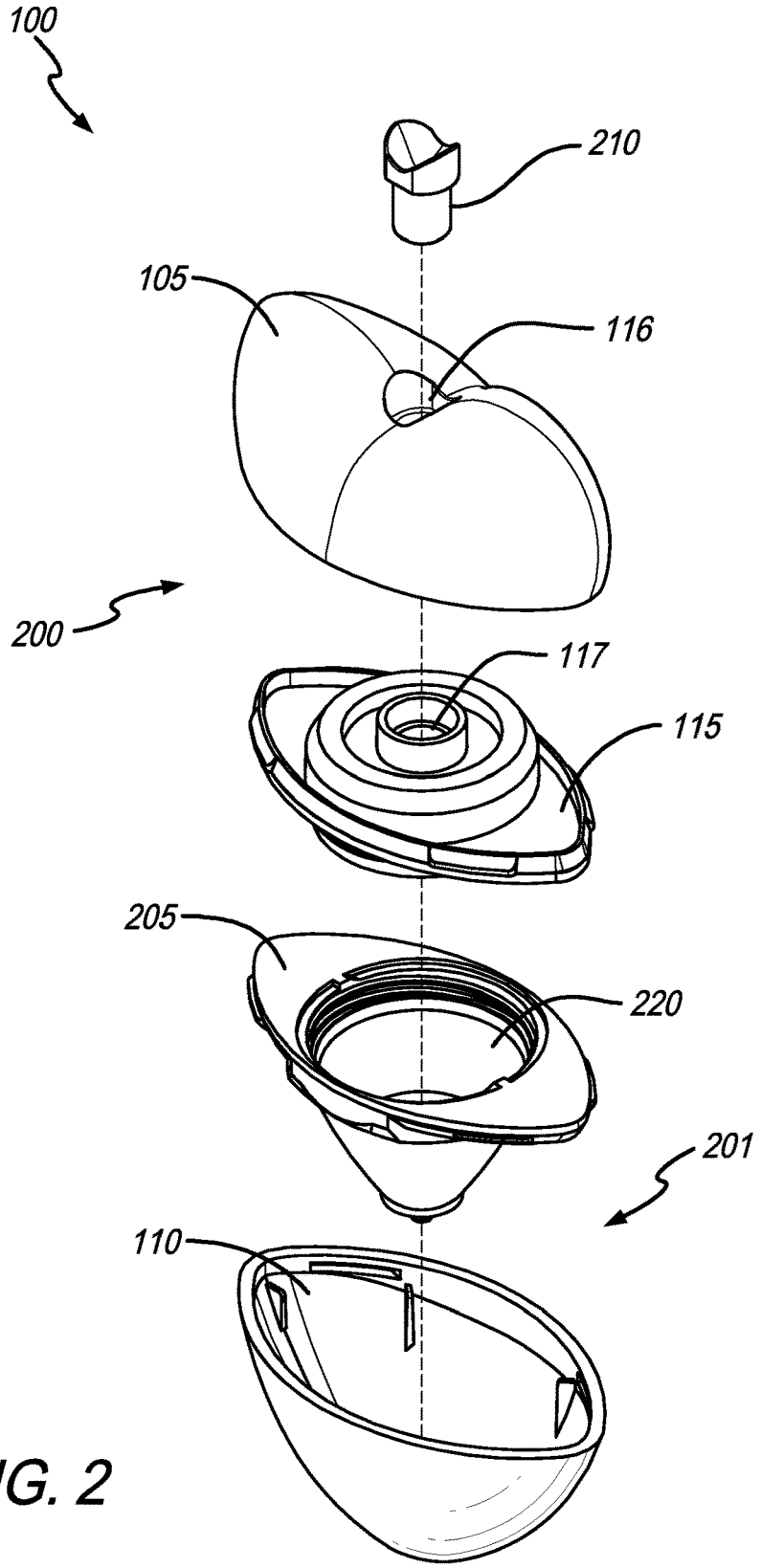
FIG. 2 is an illustration of an exploded view of one embodiment of the lip balm dispenser.

FIG. 2 is an illustration of an exploded view of one embodiment of the lip balm dispenser. The lip balm dispenser 100 may be configured to house lip balm for application by a user. Preferably, a user may apply the lip balm over a surface such as his or her lips. The lip balm may comprise a blend of wax and/or oil in solid form. In particular, the lip balm may comprise a blend of shea butter, jojoba oil, beeswax, coconut oil, olive oil, petroleum, or petroleum-based products. Further, the lip balm may comprise various ingredients, including, but not limited to, emollients, ultraviolet protective agents, moisturizers, vitamins, aloe vera, colorants, fragrances, and the like. However, the lip balm is not limited to the aforementioned ingredients and may be comprised of any suitable lip balm material.

The lip balm may be integrated with the lip balm dispenser using a hot pour method. The hot pour method may combine a variety of the aforementioned ingredients and heat them until these ingredients reach a liquefied balm. The liquefied balm is then poured into the dispenser where it is molded to a shape that is substantially conical.

As shown in FIG. 2, the dispenser 100 may comprise base portion 200 and cap portion 201. Although the base portion 200 and cap portion 201 may be each be a unitary piece, FIG. 2 shows that they comprise two portions each. The base portion 200 may comprise a heart-shaped exterior 105 and a support portion 115. These two portions may be permanently or removeably connected to form the base portion 200. The cap portion 201 may comprise a mold portion 205 and a heart-shaped exterior 110. These two portions may be permanently or removeably connected to form the cap portion 201.

In preparation for the hot pour method, the lip balm dispenser 100 may be assembled such that the base portion 200 is removeably (preferably through threading) connected to the cap portion 201. The plug 210 has not yet been inserted into the aperture 116, which is where the liquid balm is poured into the interior of the dispenser 100. The interior of the lip balm dispenser 100, including the interior surface 220 of mold portion 205, may be coated with a release agent prior to pouring the liquefied balm. The release agent may allow for efficient and clean removal of the cap portion 201 by a user when accessing the solidified lip balm.

After the coating step, the liquefied balm may be poured into the lip balm dispenser 100 via the aperture 116 in the base portion 200 of the lip balm dispenser 100. The liquefied balm preferably fills the space within mold portion 205 and the surface of support portion 115. The support portion 115 is not coated, so the liquefied balm, when cool, sticks to the support portion 115, which serves as a base for the lip balm. As shown, the mold portion 205 may have a conical interior surface 220, which forms the lip balm into a cone. This cone-shaped lip-balm may engage comfortably with the lips of the user.

Once the dispenser 100 is filled with the balm, the plug 210 is inserted into the aperture 116. The plug 210 may have a top portion, which, as shown, preferably conforms to the contours of the heart-shaped exterior 105. The plug 210 preferably may engage with aperture 117 of the support structure.

Within the support portion 115, one or more fins may provide additional surface tension onto which the solidified lip balm adheres. Once the liquefied balm has sufficiently cooled and hardened, a user may grip and twist the cap portion 201 off the base portion 200 in order to open the lip balm dispenser 100 and apply lip balm.

Once inserted into the aperture 116, the plug 210 is preferably not removable, or at least not easily removable from the aperture by the user.

Figure 3:
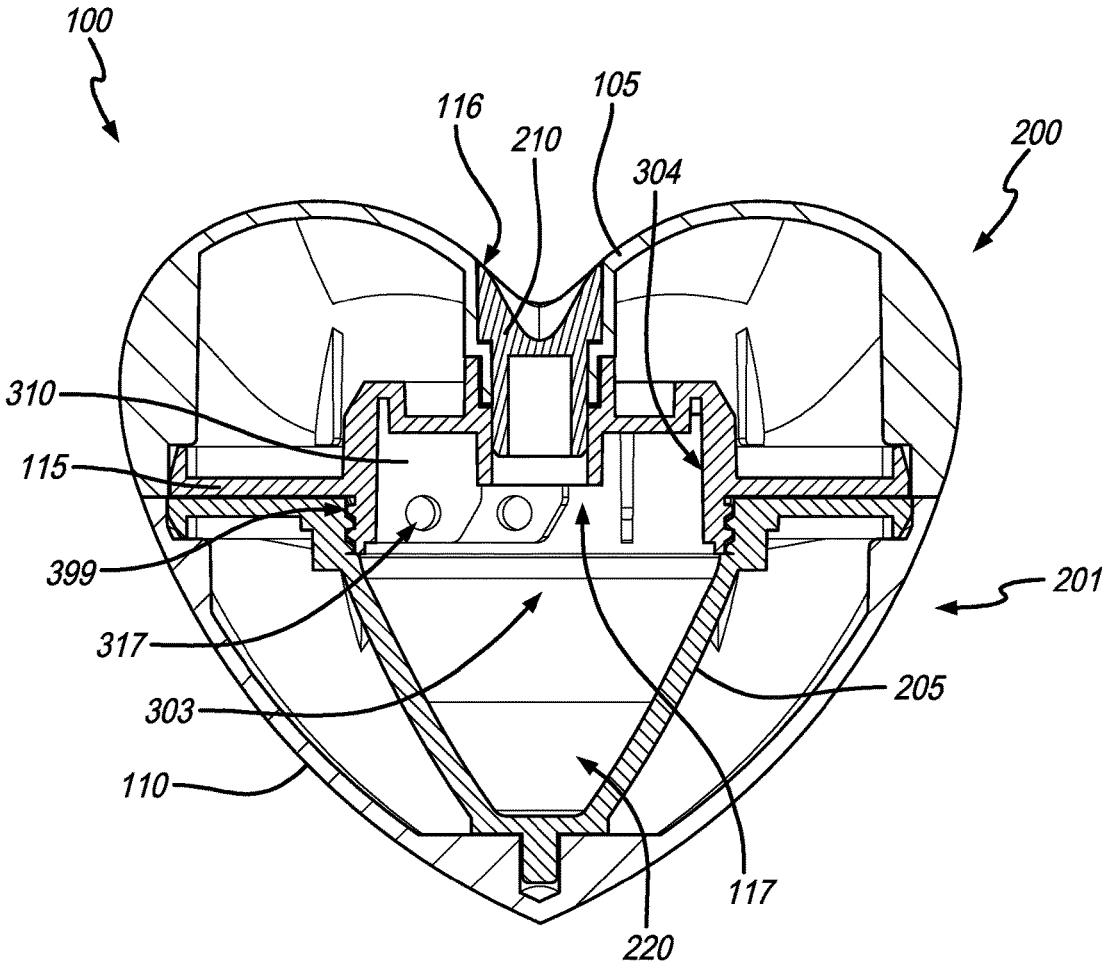
FIG. 3 is an illustration of a front cross-section view of one embodiment of the lip balm dispenser.

FIG. 3 is an illustration of a front cross-section view of one embodiment of the lip balm dispenser. As shown in FIG. 3, one embodiment of the dispenser 100 may comprise a base portion 200 and cap portion 201. Although the base portion 200 and cap portion 201 may each be a unitary piece, FIG. 3 shows that the base portion 200 and cap portion 201 may comprise two portions each. Specifically, the base portion 200 may comprise a heart-shaped exterior 105 and a support portion 115. These two portions may be permanently or removeably connected to form the base portion 200. The cap portion 201 may comprise a mold portion 205 and a heart-shaped exterior 110. These two portions may be permanently or removeably connected to form the cap portion 201.

FIG. 3 shows that the plug 210 is adapted to matingly fit into the aperture 116 so that aperture 116 and aperture 117 are blocked by the plug 210.

FIG. 3 also shows that the base portion 200 and the cap portion 201 may be threadably engaged via threads 399 so that the exterior portion 105 and the exterior portion 110 together match up to form a heart-shaped exterior. When the base portion 200 and the cap portion 201 are unscrewed from each other, the heart shape exterior is divided into two pieces. Although a threaded engagement is shown and preferred, other connection mechanisms may be used, including, but not limited to friction and snaps.

FIG. 3 shows that when the base portion 200 and cap portion 201 are engaged, they form a cavity 303. The cavity 303 is preferably filled with liquid lip balm that, when cooled, can be applied to the lips of a user. The cavity 303 may be bounded by the conical interior surface 220 of the mold portion 205 and the support structure 115. The support structure may have a support surface 304, which may support and/or comprise one or more fins 310. The liquid lip balm, after filling the cavity 303 and cooling, adheres to support surface 304 and fins 310. The cooled lip balm preferably does not adhere to the interior surface 220. In this manner, when the top portion is removed from the base portion, the lip balm may be supported by the support structure 115 and preferably projects distally away from the support structure 115 and preferably has a conical shape. The fins 310 may have holes 317, or other structures, which may increase the surface area and surface tension for the lip balm, so that the lip balm does not unintentionally fall off the support structure 115 when in use. The fins 310 may extend approximately perpendicularly from a support surface 304 of the support structure 115. The holes 317 may further facilitate the adhesion of the cooled lip balm within or to the support structure 115.

The exterior 105 and the support structure 115 may be connected via one or more friction fasteners (snapped together) or they may be one unitary piece. The exterior 110 and mold 205 may be connected via one or more friction fasteners (snapped together) or they may be one unitary piece.

The support structure 115 may be adapted to accept and retain a liquefied balm. Further, one or more fins 305 within the support structure 200 may provide additional surface tension onto which the liquefied balm can adhere.

Figure 4:
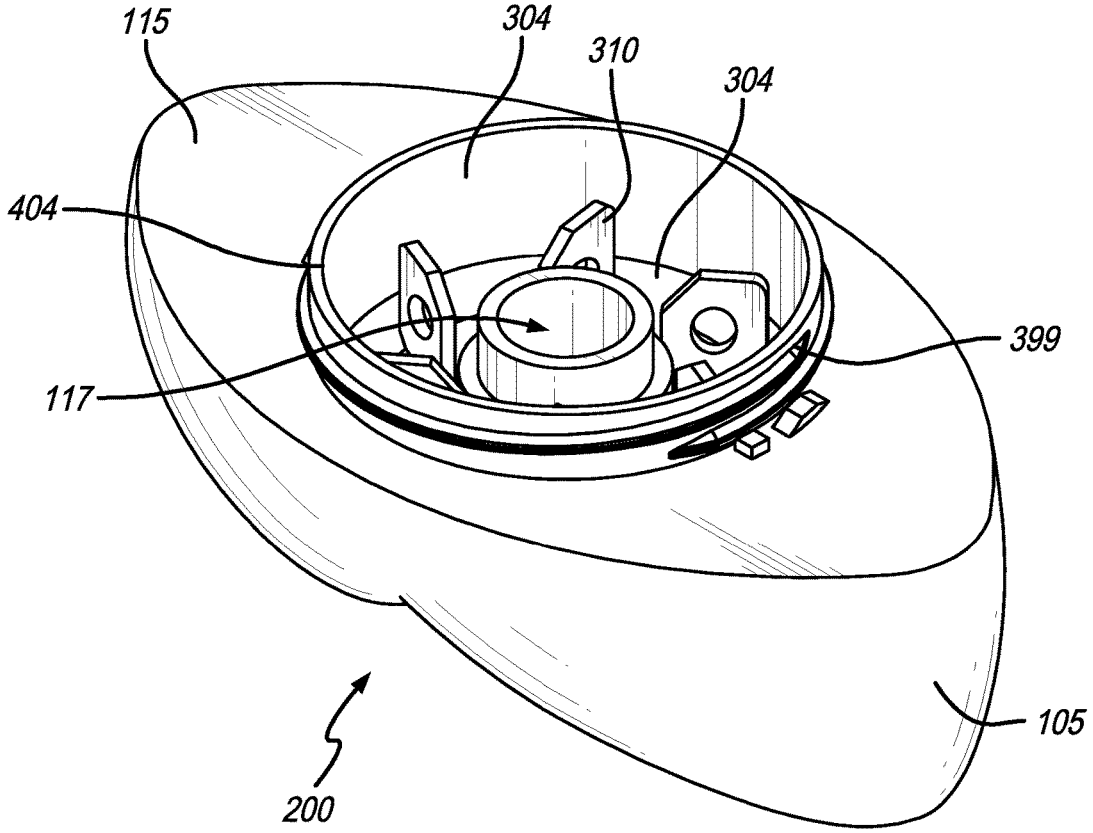
FIG. 4 is an illustration of an interior view of one embodiment of the support structure of the lip balm dispenser.

FIG. 4 is an illustration of an interior view of one embodiment of the support structure of the lip balm dispenser. As shown in FIG. 4, one embodiment of the support structure 115 may be substantially oblong-shaped, as a cross-section of a heart-shaped exterior 105 of base portion 200. The support structure 115 may comprise a lip 404, which generally defines and/or bounds an interior surface 304. The lip may also be adapted to engage and secure a cooled lip balm. FIG. 4 shows aperture 117, which allows the hot lip balm to be poured into the cavity of the lip balm dispenser 100. After the balm is poured and/or cooled, the plug 210 may block aperture 117. The support structure may comprise threads 399 for connecting the base portion 200 to the cap portion 201.

The interior surface 304 may comprise one or more fins 310, which ring the aperture 117 and help support and hold the cooled lip balm. As shown in FIG. 4, the fins preferably do not touch the rim 404. The fins 310 may or may not touch the rim of the aperture 117.

Figure 5:
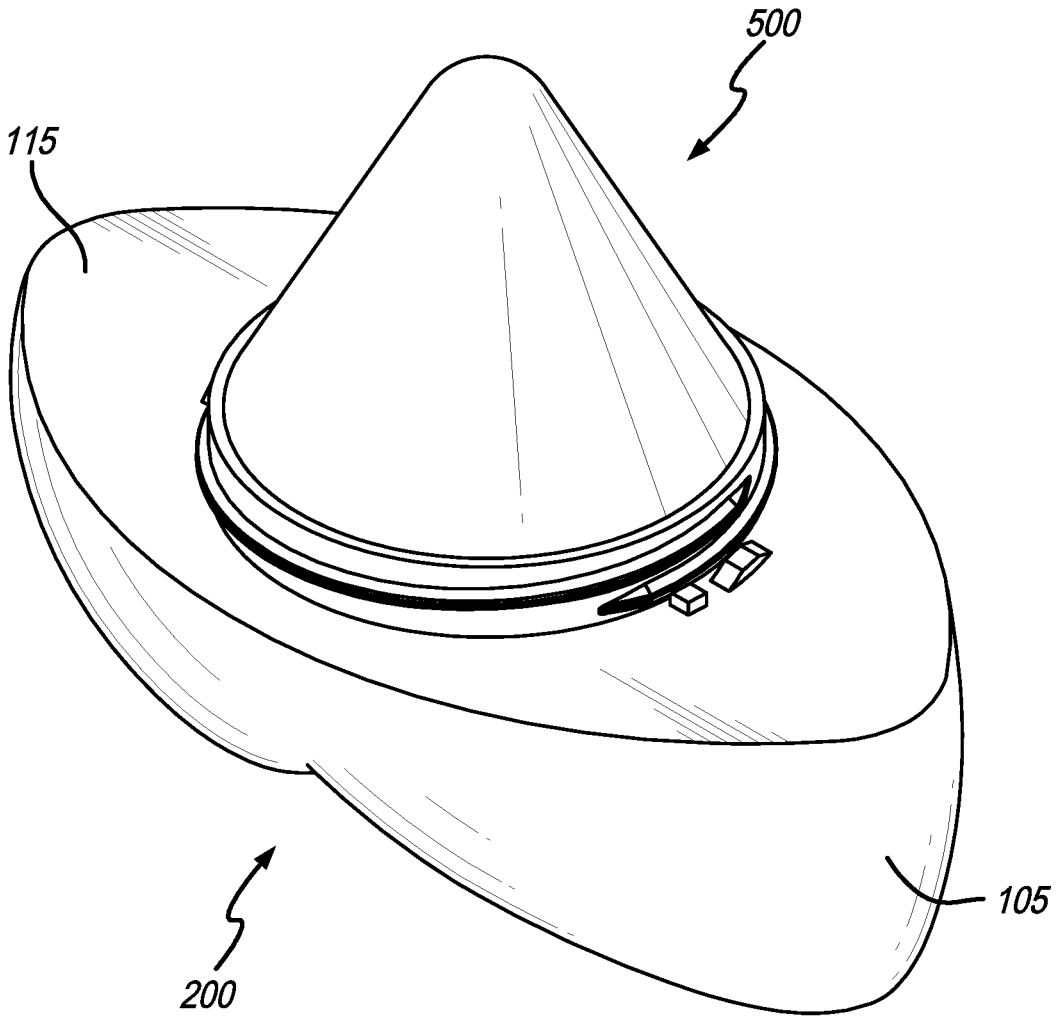
FIG. 5 is an illustration of an interior view of one embodiment of the support structure of the lip balm dispenser supporting lip balm cooled into a solid conical shape.

FIG. 5 is an illustration of an interior view of one embodiment of the support structure of the lip balm dispenser supporting lip balm cooled into a solid conical shape. FIG. 5 shows that the lip balm 500 may cool into a solid conical shape. The lip balm 500 is supported by the support structure 115 of the base portion 200. The conical shape allows for easy and efficient application of the lip balm to the lips of the user.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A lip balm dispenser, comprising:
a base portion;
a cap portion; and
a plug;
wherein said base portion is removeably connected to said cap portion;
wherein said base portion comprises an aperture, a base exterior, and a support structure;
wherein said plug is adapted to block said aperture;
wherein said support structure comprises a support surface;
wherein said cap portion comprises a mold portion and a cap exterior;
wherein said mold portion is substantially conical in shape;
wherein when said base portion is connected to said cap portion, said base exterior and said cap exterior form a substantially heart-shaped lip balm dispenser;
wherein when said base portion is connected to said cap portion, said substantially heart-shaped lip balm dispenser forms an internal cavity defined by said mold portion and said support surface;
wherein said internal cavity is configured to accept a heated lip balm through said aperture;
wherein said lip balm cools and adheres to said support surface; and
wherein said lip balm does not adhere to said mold portion after said lip balm cools.

2. The lip balm dispenser of claim 1, wherein said support structure comprises one or more fins; and
wherein said one or more fins of said support structure extend substantially perpendicularly from said support surface of said support structure.

3. The lip balm dispenser of claim 2, wherein said one or more fins of said support structure comprise one or more holes.

4. The lip balm dispenser of claim 1, wherein said base portion and said cap portion are threadably connected.

5. The lip balm dispenser of claim 1, wherein a coating is applied to said mold portion, such that said lip balm does not adhere to said mold portion after said lip balm cools.

6. The lip balm dispenser of claim 1, wherein said support surface has an outer rim that substantially surrounds said one or more fins and extends substantially perpendicularly from a base of said support surface.

7. The lip balm dispenser of claim 6, wherein said outer rim is cylindrical.

8. The lip balm dispenser of claim 7, wherein said outer rim does not contact any of said one or more fins.

9. A lip balm dispenser, comprising:
a base portion;
a cap portion;
a plug; and
a lip balm;
wherein said base portion is removeably connected to said cap portion;
wherein said base portion comprises an aperture, a base exterior, and a support structure;
wherein said plug is configured to block said aperture;
wherein said support structure comprises a support surface and one or more fins;
wherein said one or more fins have one or more holes;
wherein said cap portion comprises a mold portion and a cap exterior;
wherein said mold portion is substantially conical in shape;
wherein when said base portion is connected to said cap portion, said lip balm dispenser forms an internal cavity defined by said mold portion and said support surface;
wherein said lip balm is heated until it may be poured into said internal cavity;
wherein said internal cavity is configured to accept a heated lip balm through said aperture;
wherein said lip balm cools and adheres to said support surface and said fins; and
wherein a coating is applied to said mold portion, such that said lip balm does not adhere to said mold portion after said lip balm cools.

10. The lip balm dispenser of claim 9, wherein said one or more fins extend substantially perpendicularly from said support surface of said support structure.

11. The lip balm dispenser of claim 10, wherein said base portion and said cap portion are threadably connected.

12. The lip balm dispenser of claim 9, wherein when said base portion is connected to said cap portion, said base exterior and said cap exterior form a substantially heart-shaped lip balm dispenser.

13. A lip balm dispenser, comprising:
a base portion;
a cap portion;
a plug; and
a lip balm;
wherein said base portion is removeably connected to said cap portion;
wherein said base portion comprises an aperture, a base exterior, and a support structure;
wherein said plug is configured to block said aperture;
wherein said support structure comprises a support surface and one or more fins;
wherein said one or more fins have one or more holes;
wherein said cap portion comprises a mold portion and a cap exterior;
wherein when said base portion is connected to said cap portion, said base exterior and said cap exterior form a substantially heart-shaped lip balm dispenser;
wherein when said base portion is connected to said cap portion, said substantially heart-shaped lip balm dispenser forms an internal cavity defined by said mold portion and said support surface;
wherein said lip balm is heated until it may be poured into said internal cavity;
wherein said internal cavity is configured to accept a heated lip balm through said aperture;

wherein said lip balm cools and adheres to said support surface and said fins; and wherein a coating is applied to said mold portion, such that said lip balm does not adhere to said mold portion after said lip balm cools.

14. The lip balm dispenser of claim 13, wherein said one or more fins extend substantially perpendicularly from a base of said support surface of said support structure.

15. The lip balm dispenser of claim 14, wherein said support surface has an outer rim that substantially surrounds said one or more fins and extends substantially perpendicularly from said base of said support surface.

16. The lip balm dispenser of claim 15, wherein said outer rim is cylindrical.

17. The lip balm dispenser of claim 16, wherein said outer rim does not contact any of said one or more fins.

18. The lip balm dispenser of claim 17, wherein said one or more holes of said one or more fins help said lip balm to adhere to said support surface.

19. The lip balm dispenser of claim 13, wherein said base portion and said cap portion are threadably connected.

20. The lip balm dispenser of claim 13, wherein said mold portion is substantially conical in shape.

* * * * *